US005532441A

United States Patent [19]

Edwards, Jr. et al.

[11] Patent Number: 5,532,441

[45] Date of Patent: Jul. 2, 1996

[54] CONTACT BLOCK HAVING CONVERTIBLE NORMALLY OPEN OR NORMALLY CLOSED ELECTRICAL CONTACT

[75] Inventors: Stanley H. Edwards, Jr.; Richard Marshall; Tony R. Robbins, all of Raleigh, N.C.

[73] Assignee: Square D Company, Palatine, Ill.

[21] Appl. No.: 322,631

[22] Filed: Oct. 13, 1994

[51] Int. Cl.[6] ..... H01H 1/34; H01H 15/02

[52] U.S. Cl. ..... 200/16 A; 200/280; 200/281

[58] Field of Search ..... 200/16 R–16 F, 200/280, 281, 243–247, 293–307; 335/195–204

[56] References Cited

U.S. PATENT DOCUMENTS

| | | | |
|---|---|---|---|
| 2,532,305 | 12/1950 | Heller | 200/281 |
| 2,885,516 | 5/1959 | Goudy et al. | 200/281 |
| 3,328,552 | 6/1967 | Gribble et al. | 200/280 |
| 3,436,497 | 4/1969 | Mading | 200/16 A |
| 3,641,287 | 2/1972 | Hughes | 200/16 A |
| 4,052,582 | 10/1977 | Muller et al. | 200/16 A X |
| 4,087,770 | 5/1978 | Kuhn et al. | 335/202 X |
| 4,184,134 | 1/1980 | Kane et al. | 335/198 |
| 4,355,216 | 10/1982 | Kane et al. | 200/16 A |
| 4,663,502 | 5/1987 | Kane et al. | 200/16 A X |
| 4,713,498 | 12/1987 | Ludwig et al. | 200/16 A X |
| 4,774,484 | 9/1988 | Lehman et al. | 335/197 |

*Primary Examiner*—J. R. Scott

*Attorney, Agent, or Firm*—Larry I. Golden; David Russell Stacey; Larry T. Shrout

[57] ABSTRACT

The present invention defines a convertible electrical contact. The convertible contact comprises two pair of movable contacts attached to an actuator which is supported by and enclosed within a housing. The actuator is biased to a first position and is slidably movable to a second position in response to a force applied to the actuator. The movable contacts are attached to the distal ends of a flexible member which is supported at its approximate midpoint by the actuator. The movable contacts are also movable between a first position and a second position as the actuator is moved. A pair of contact cavities are defined by the housing such that the one contact cavity lies on each side of the actuator and the flexible member and movable contacts are contained within the cavities. The housing defines a first pair of access apertures associated with the first position of the movable contacts and a second pair of access apertures associated with the second position of the movable contacts. A convertible stationary contact module which includes a pair of bussing conductors, each with a stationary contact attached at its end is employed to complete the electrical contact. By selectively placing the bussing conductors and their associated stationary contacts in either the first or second pair of access apertures either a normally closed or a normally open electrical contact can be chosen. The contact module is attached to the outside of the housing by a mounting screw.

35 Claims, 6 Drawing Sheets

CONTACT BLOCK HAVING CONVERTIBLE NORMALLY OPEN OR NORMALLY CLOSED ELECTRICAL CONTACT

FIELD OF THE INVENTION

The invention is related to electrical contacts for making or breaking an electrical circuit and more particularly to a contact block having a stationary set of contacts which can be selectively converted to either normally open or normally closed contacts.

BACKGROUND OF THE INVENTION

It is common to use a contact block having either a normally closed or a normally open contact to control the current flowing in an electrical circuit. The contact block can typically be used in a limit switch, with a push button operator to form a push button switch, or in any other situation wherein an object can physically move an actuator thereby causing the normally closed or normally open contacts to change state. The contact block generally comprises a first pair of stationary contacts and a pair of movable contacts attached to the actuator. The actuator is biased such that the movable contacts are either in the closed or open position with relation to the first stationary contacts. It is also known to have a second pair of stationary contacts spaced apart from the first pair of stationary contacts such that the pair of movable contacts are located between the first and second stationary contacts, thus allowing the contact block to have one normally open contact and one normally closed contact. The extra set of stationary contacts increases the physical size of the contact block and significantly increases the cost since two additional stationary contacts, two wiring terminals and the bussing connecting the contacts to the terminals are required. If an application requires two contacts of the same type it is common to "stack", contact blocks together This is accomplished by attached one contact block to another, such that each subsequent contact block is operated by the actuator of the contact block to which it is attached. Since the options described above each add additional cost to the contact block, it would be desirable to have a contact block which is comparable in size and cost to a single function contact block of the prior art and yet is easily converted from a normally open to a normally closed contact block. It is also desirable to have a contact block which is easily converted from a normally open normally closed combination to either two normally closed or two normally open contacts.

In other types of circuit control devices employing a stationary contact and a movable contact operated by an actuator to make or break the circuit it is sometimes required that an additional control circuit be operated by the same actuator. For these applications it is common to provide an auxiliary contact. The auxiliary contact is generally contained within an enclosure and includes a pair of stationary contacts, a pair of movable contacts mounted on an actuator, a biasing spring, and a pair of wire terminal connectors. The auxiliary contact enclosure is mounted on the outside of the circuit control device enclosure in a location that permits access to the primary contactor actuator such that the auxiliary contact can be operated simultaneously with the primary contactor. Therefore, the trip mechanism of the primary contactor must be designed to overcome not only the biasing spring and latching friction of the primary contacts but also the biasing spring of the auxiliary contact.

This increases the cost of the circuit control device regardless of whether or not an auxiliary contact is employed. The auxiliary contacts, like the contact blocks, are available in either a normally open or a normally closed function and must be purchased separately as an accessory for the control device. This means that an inventory of both normally open and normally closed auxiliary contacts is required to insure that the desired auxiliary contact is available when required. It would therefore be desirable to have a circuit control device with an internal auxiliary contact that can be easily converted from a normally open to a normally closed contact and which does not have an additional biasing spring for the trip mechanism to overcome.

SUMMARY OF THE INVENTION

The present invention provides a convertible contact which can be selectively and easily changed between a normally open function and a normally closed function by the user. The convertible contact of the present invention can be used with any electrical control device capable of having two spaced apart movable contacts located on a common movable actuator member. The convertible contact of the present invention can be used as the primary contact of a contact block or an auxiliary contact of other circuit control devices.

Other features and advantages of the invention will become apparent to those skilled in the art upon review of the following detailed description, claims and drawings.

Figure 1:
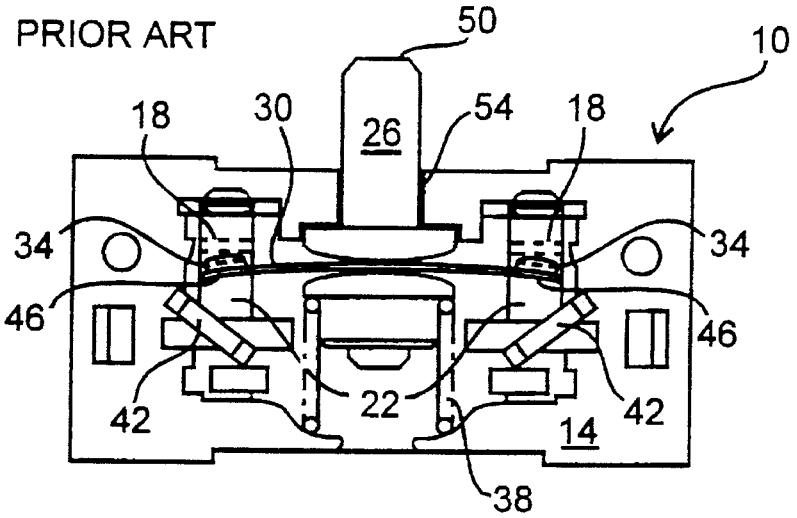
FIG. 1 is an interior view of a typical normally closed contact block of the prior art.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

FIG. 1 illustrates the inside of a contact block of the prior art generally and is indicated by reference numeral 10. The contact block 10 includes a housing 14 which defines a generally hollow interior for supporting and enclosing at least one pair of stationary contacts 18, at least one pair of bussing members 22, a portion of an actuator 26, at least one flexible member 30 supported by the actuator 26, at least one pair of movable contacts 34, and an actuator biasing spring 38.

Each pair of stationary contacts 18 is positioned within the housing 14 such that one stationary contact 18 is spaced apart from the other stationary contact 18 a preselected distance and both lie in a common plane. Each stationary contact 18 is connected to one end of an associated bussing member 22. A terminal end 42 of each bussing member 18 extends outboard of the housing 14 through a passage 44 in the housing 14. Each flexible member 30 is generally rectangular in shape and is supported at its approximate midpoint by the actuator 26 such that it has two opposing ends 46 being spaced apart a preselected distance. Each flexible member 30 is positioned generally perpendicular to the longitudinal axis of the actuator 26 and parallel to the plane of the pairs of stationary contacts 18. At least one movable contact 34 is attached at each of the opposing ends 46 of the flexible member 30.

The actuator 26 has a distal end 50 which extends outboard of the housing 14 through a passage 54 in the housing 14. The actuator 26 is slidably movable along its longitudinal axis between a first position and a second position. The biasing spring 38 is located between a portion of the housing 14 and the actuator 26 urging the actuator 26 to maintain its first position. An external force exerted on the distal end 50 of the actuator 26 is required to move the actuator 26 to its second position. In the configuration of FIG. 1, the stationary contacts 18 are positioned within the housing 14 such that when the actuator 26 is biased by the spring 38 to its first position, the movable contacts 34 are in contact with the stationary contacts 18 thereby providing a contact block having normally closed contacts.

Figure 2:
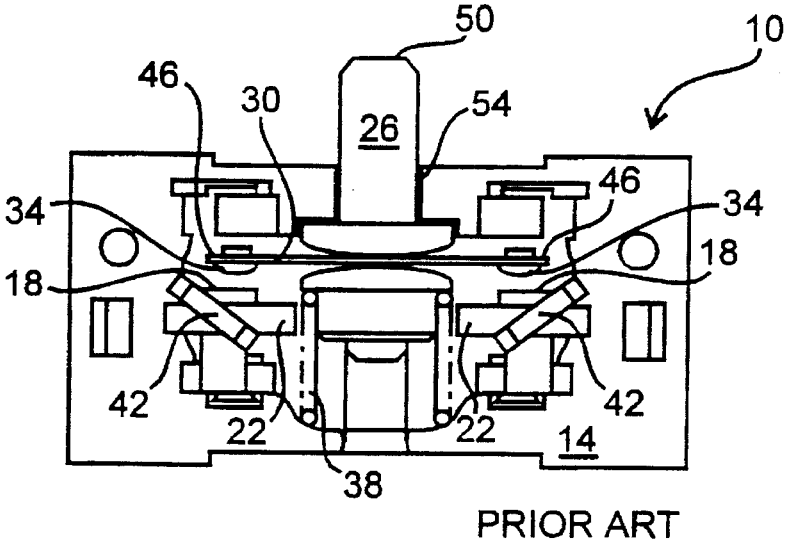
FIG. 2 is an interior view of a typical normally open contact block of the prior art.

In the configuration of the prior art contact block shown in FIG. 2, the stationary contacts 18 are positioned within the housing 14 such that when the actuator 26 is biased by the spring 38 to its first position, the movable contacts 34 are spaced apart from the stationary contacts 18 thereby providing a contact block having normally open contacts.

Figure 3:
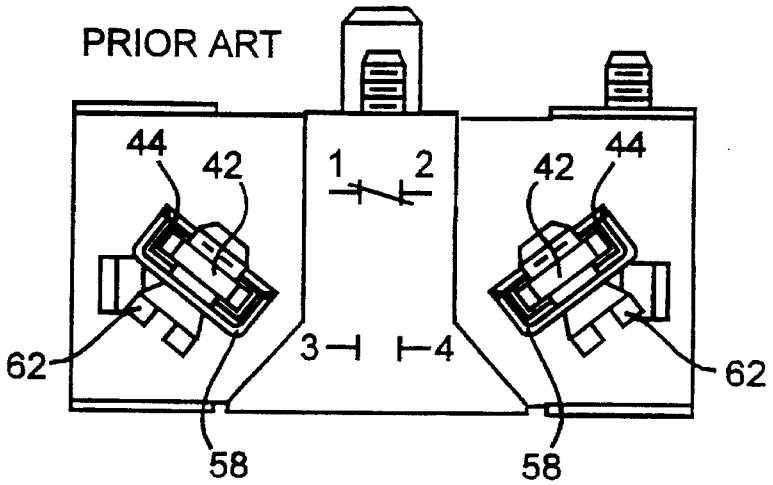
FIG. 3 is an exterior view of a typical contact block of the prior art.

FIG. 3 illustrates an assembled prior art contact block with a terminal clamp 58 and a screw 62 fitted to each of the extending terminal ends 42.

Figure 5:
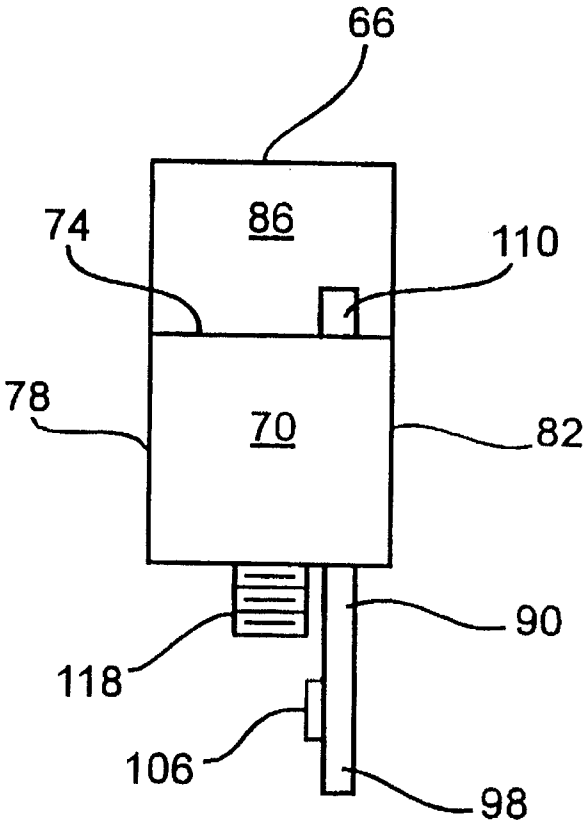
FIG. 5 is an end view of a convertible auxiliary contact constructed in accordance with the present invention.
Figure 4:
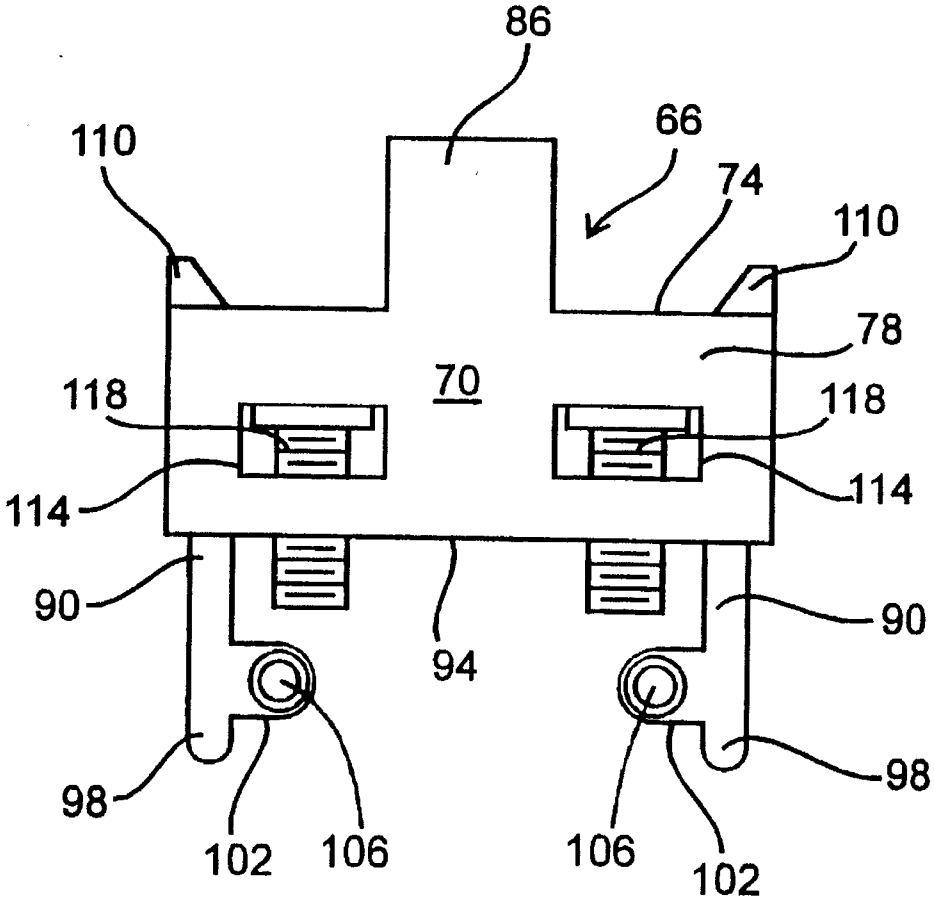
FIG. 4 is a front view of a convertible auxiliary contact constructed in accordance with the present invention.

FIGS. 4 and 5 illustrate a convertible stationary contact module 66 constructed in accordance with the present invention. The contact module 66 includes a housing 70 which is generally rectangular in shape. The housing 70 has a generally flat top surface 74, a front surface 78 and a back surface 82. The front and back surfaces, 78 and 82 respectively, are generally parallel to one another and spaced apart by the top surface 74. A generally rectangular handle 86 extends upward from a middle portion of the top surface 74. Two generally flat bussing conductors 90 are supported by and partially enclosed by the contact module housing 70. A portion of each bussing conductor 90 extends outwardly from and generally perpendicular to a bottom surface 94 of the housing 70 to a distal end 98. The bussing conductors 90 pass through the housing 70 at a point between the longitudinal center line of the contact module 66 and the back surface 82 of the housing 70. The distal end 98 of each bussing conductor 90 has a contact pad 102. A stationary contact 106 is fixed to the side of the contact pad 102 facing toward the front surface 78 of the housing 70. A contact indicator 110 extends outwardly from and generally perpendicular to the top surface 74 at a point between the longitudinal center line of the contact module 66 and the back surface 82. The contact indicators 110 indicate the position of the bussing conductors 90 and the stationary contacts 106. Two passages 114, each communicating between the front and back surfaces, 78 and 82 respectively, and each located adjacent one of the bussing conductors 90, provide access to a wire terminal screw 118 (also shown in FIG. 8) for external wiring to the contact module 66.

Figure 6:
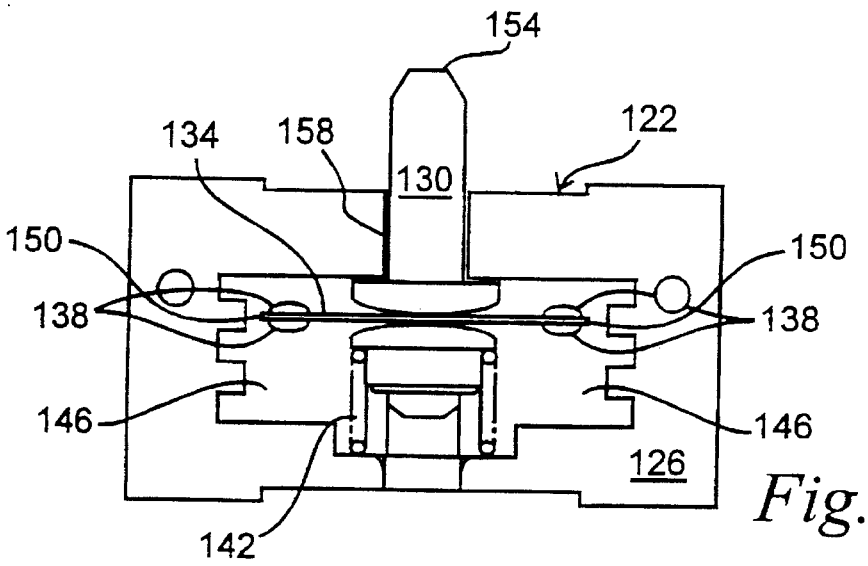
FIG. 6 is an interior view of a contact block constructed in accordance with the present invention.

FIG. 6 illustrates the interior of a contact block 122 constructed in accordance with the present invention. As in the prior art discussed above, the contact block 122 of the present invention has a housing 126 which defines a generally hollow interior for supporting and enclosing an actuator 130, at least one flexible member 134 supported by the actuator 130, two pairs of movable contacts 138 and an actuator biasing spring 142. However, in accordance with the present invention, a generally rectangular contact cavity 146 is defined on each side of the actuator 130. The contact cavities 146 receive the stationary contacts 106 of the contact module 66 shown in FIGS. 4 and 5.

Each flexible member 134 is generally rectangular in shape and is supported at its approximate midpoint by the actuator 130 such that it has two distal ends 150 being spaced apart a preselected distance. Each flexible member 134 lies in a plane generally perpendicularly to the longitudinal axis of the actuator 130. At least one movable contact 138 is attached to each side of the flexible member 134 at each of the distal ends 150.

The actuator 130 has a distal end 154 which extended outboard of the housing 126 through a passage 158 in the housing 126. The actuator 130 is slidably movable along its longitudinal axis between a first position and a second position. The biasing spring 142 is located between a portion of the housing 126 and the actuator 130, thereby urging the actuator 130 to maintain its first position. An external force exerted on distal end 154 or the actuator 130 is required to move the actuator 130 to its second position.

Figure 7:
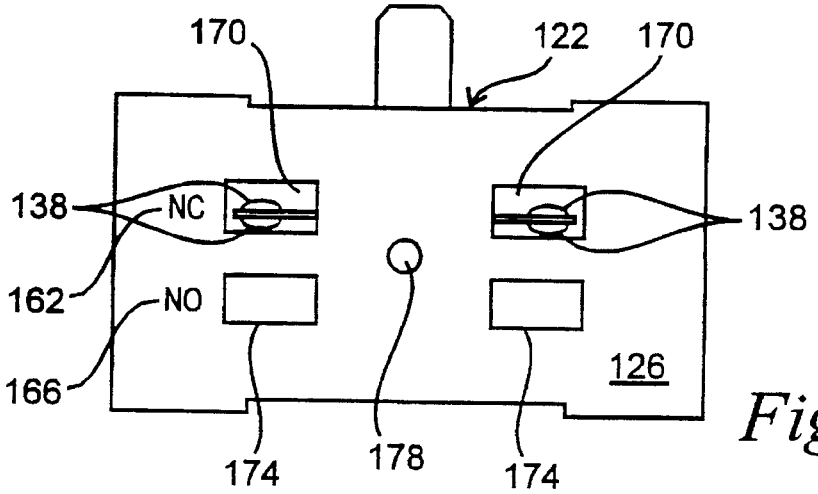
FIG. 7 is an exterior view of a contact block constructed in accordance with the present invention.

FIG. 7 illustrates an assembled contact block 122 of the present invention. The housing 126 includes indicia indicating normally closed (NC) 162 and normally open (NO) 166. Two generally rectangular apertures 170 generally adjacent to the NC indicia 162 provide access to the two contact cavities 146 at a location coinciding with the location of the movable contacts 138 when the actuator 130 is in the first position. Two generally rectangular apertures 174 generally adjacent to the NO indicia 166 provide access to the two contact cavities 146 at a location coinciding with the location of the movable contacts 138 when the actuator 130 is in the second position. The stationary contacts 106 and their associated bussing conductors 90, shown in FIGS. 4 and 5, are received in apertures 170 when a normally closed contact block is desired and in apertures 174 when a normally open contact block is desired. An aperture 176 is provided for receiving a contact module mounting screw 178.

Figure 8:
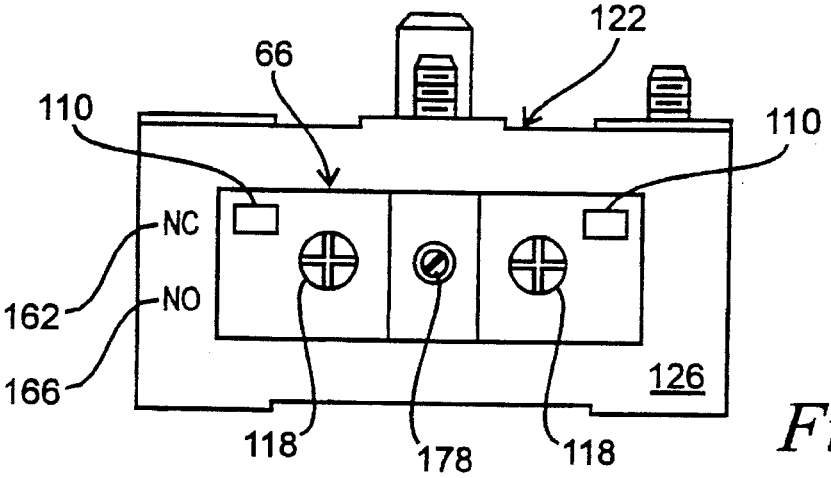
FIG. 8 is exterior view of a contact block constructed in accordance with the present invention with a convertible stationary contact installed in the normally open position.

FIG. 8 illustrates a contact block 122 of the present invention with a contact module 66 of the present invention installed. The contact module 66 is in the normally closed position as indicated by the contact indicator 110 adjacent to the NC indicia 162. The contact module is attached to the contact block housing 126 by the mounting screw 178. The contact block is easily changed from normally closed to normally open by removing the mounting screw 178, removing the contact module 66 from the contact block 122, rotating the contact module 66 180° and reinstalling the contact module 66 on the contact block 122.

Figure 9:
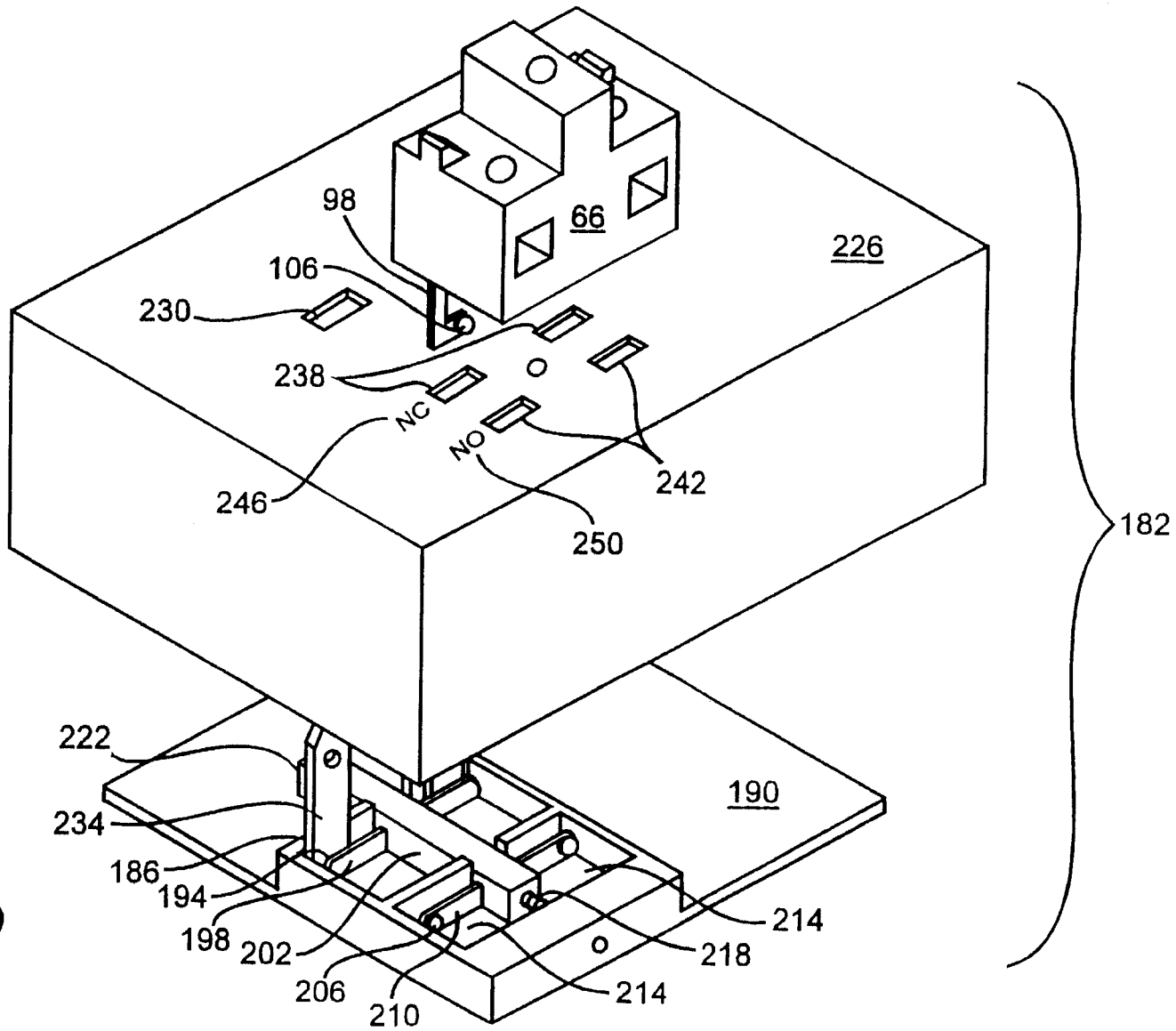
FIG. 9 is an exploded view of a circuit control device having a conventional dedicated contact and a convertible auxiliary contact in accordance with the present invention operated by a common actuator.

FIG. 9 illustrates a circuit control device generally indicated by reference numeral 182 having a pair of dedicated nonconvertible stationary contacts 186 supported by a base 190, a first pair of movable contacts 194 supported by a first flexible member 198 which is attached to an actuator 202, two pair of second movable contacts 206 supported by a second flexible member 210 which is also attached to the actuator 202 and a pair of contact cavities 214 defined by the base 190. The actuator 202 is biased to a first position by a spring 218 and slidably movable to a second position by a force exerted on an end 222 of the actuator 202. The base 190 and its associated components are enclosed within a housing 226. The housing 226 defines a pair of terminal apertures 230 for receiving the terminal ends 234 of the dedicated stationary contacts 186, a first pair of access apertures 238 and a second pair of access apertures 242 which provide access to the contact cavities 214. The first pair of access apertures 238 are associated with the second pairs of movable contacts 206 when the actuator 202 is in the first position and the second pair of access apertures 242 are associated with the second pair of movable contacts 206 when the actuator 202 is in the second position. The housing 226 also includes NC indicia 246 adjacent the first pair of access apertures 238 and NO indicia 250 adjacent the second pair of access apertures 242. The pairs of access apertures 238 and 242 receive the bussing conductors 98 and stationary contacts 106 of the convertible contact module 66, thereby providing the circuit control device 182 with a convertible auxiliary contact which is easily selectable between a normally closed contact and a normally open contact.

Figure 10:
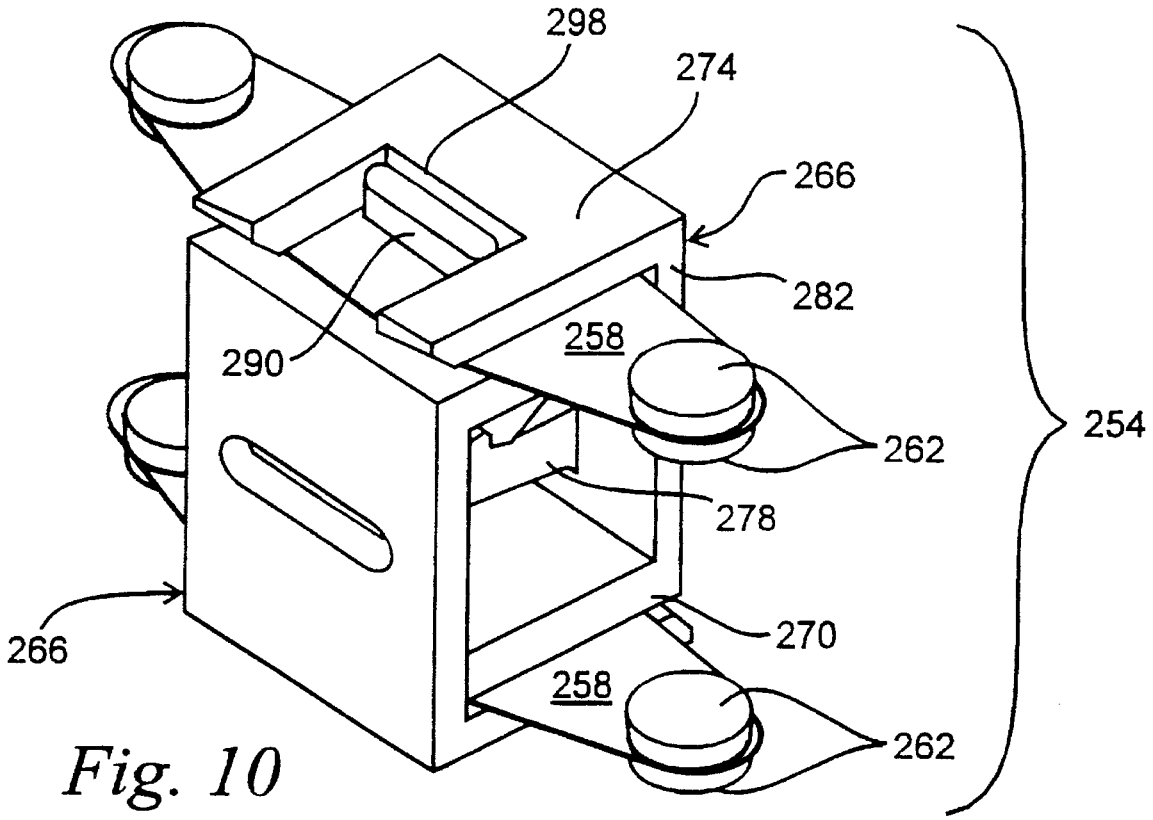
FIG. 10 is an isometric view of an alternate construction for a contact carrier/acturator for supporting two sets of movable contacts.
Figure 11:
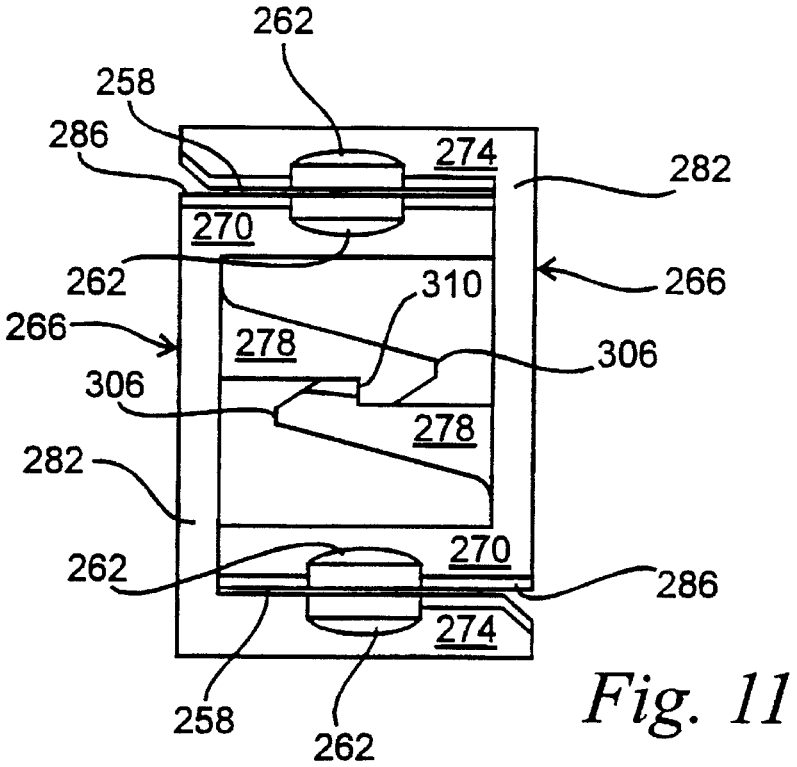
FIG. 11 is an end view of the assembled contact carrier/actuator of FIG. 10.
Figure 12:
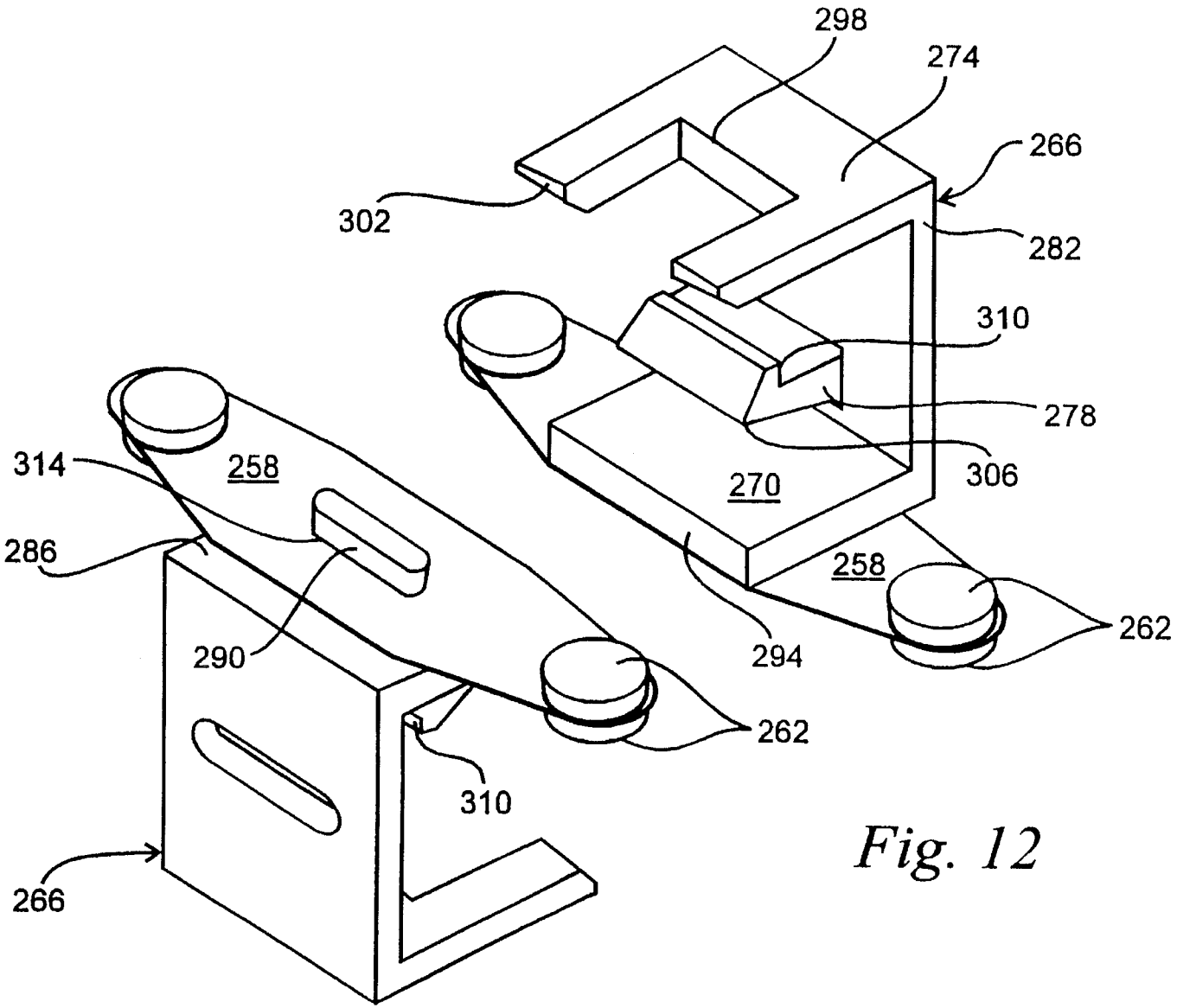
FIG. 12 is an exploded view of the contact carrier/actuator of FIG. 10.

A contact carrier/actuator assembly generally indicated as reference numeral 254 and illustrated in FIGS. 10, 11 and 12 provides a simple easily assembled method of supporting two flexible members 258 each of which has two movable contacts 262 attached to opposing sides of each of its opposing ends. The contact carrier/actuator assembly 254 consists of two identical opposing halves 266 which snap together and thereby captivate one flexible member 258 at each end of the assembly 254. Each half 266 has a generally E-shaped cross-section wherein a first outside leg 270, a second outside leg 274 and a center leg 278 each extending outwardly from and generally perpendicular to a base leg 282. The first outside leg 270 is shorter in length than the second outside leg 274 by an amount approximately equal to the thickness of the base leg 282. The center leg 278 is slightly shorter than the first and second outside legs, 270 and 274 respectively, and is not centered between the first and second outside legs, 270 and 274 respectively. The first outside leg 270 has a generally flat outside surface 286 from which a generally rectangular rib 290 extends outwardly and perpendicularly. The rib 290 is located approximately at the middle of the first outside leg 270 and runs generally parallel to a distal end 294 of the first outside leg 270. The outside second leg 274 defines a generally square slot 298 which extends inward from a distal end 302 of the second outside leg 274. The slot 298 is dimensioned to slidingly receive the rib 290 of said first outside leg 270. The center leg 278 includes a generally wedge-shaped distal end 306 which defines a hook 310. The center leg 278 is positioned such that when the two halves 266 are assembled together, the rib 290 of one half 266 is slidably received within the slot 298 of the opposing half 266 and the hooks 310 of the opposing center legs 278 interlock, thereby holding the contact carrier/actuator assembly 254 together. The flexible members 258 each have a slot 314 which is dimensioned to closely receive the rib 290 on the cooperating first outside leg 270. To assemble the contact carrier/actuator assembly 254, one flexible member 258 with its attached movable contacts 262 is placed on the generally flat outside surface 286 of the first outside leg 270 of each of the opposing halves 266 such that the rib 290 is received through the slot 314. The two opposing halves 266 are then aligned such that the ribs 290 of each first outside leg 270 are slidably received within the slots 298 of the second outside leg 274 of the opposing half 266. As the two halves 266 are pressed together the hooks 310 of both center legs 278 become latched together. The flexible members 258 are capitivated between the generally flat surfaces 286 of the first outside legs 270 and the second outside legs 274 such that the ribs 290 prevent them from sliding out. Because the contact carrier/actuator assembly 254 is symmetrical, no special positioning is required during assembly.

We claim:

1. A contact block having at least one set of electrical contacts convertible between a normally open and normally closed state comprising:

a housing defining a generally hollow interior;

an actuator partially received within said housing and being slidably movable between a first position and a second position;

means for biasing said actuator to said first position;

at least one pair of contact cavities being defined by said housing and being positioned immediately adjacent to and on opposite sides of said actuator;

at least one pair of movable contacts, said movable contacts being attached to said actuator such that said movable contacts are movable between a first position and a second position within said contact cavities;

means for attaching said movable contacts to said actuator;

at least two pair of access apertures providing access to said contact cavities such that one pair of said access apertures generally coincides with said first position of said movable contacts and one pair of said access apertures generally coincides with said second position of said movable contacts; and a stationary contact module having at least one pair of stationary contacts which can be received through either of said pairs of access apertures for being selectively engaged with said movable contacts in one of said first or second positions.

2. The contact block of claim 1 wherein said actuator has a distal end which extends outboard of said housing through a passage.

3. The contact block of claim 2 wherein said actuator is selectively movable from said first position to said second position in response to an external force exerted on said distal end of said actuator.

4. The contact block of claim 1 wherein said biasing means is a spring positioned between a portion of said housing and said actuator.

5. The contact block of claim 1 wherein said actuator is made from an electrically nonconductive material.

6. The contact block of claim 5 wherein said means for attaching said movable contacts to said actuator is a flexible member, said flexible member being generally flat and made from an electrically conductive material.

7. The contact block of claim 6 wherein said flexible member is rigidly supported at its approximate midpoint by said actuator such that said flexible member is generally perpendicular to said actuator, said flexible member having two opposing ends extending away from said actuator.

8. The contact block of claim 7 wherein one said movable contact is attached to each of the opposing sides of said flexible member at each of said opposing ends.

9. The contact block of claim 1 wherein said housing further includes an NC indicia adjacent one said pair of access apertures indicating a normally closed function and an NO indicia adjacent the other said pair of access apertures indicating a normally open function.

10. The contact block of claim 9 wherein said stationary contact module includes a housing being generally rectangular in shape such that it is defined by a top surface and a bottom surface being generally parallel to and spaced apart from one another, and a front surface and a back surface being generally parallel to and spaced apart from one another, said front and back surfaces being intermediate said top and bottom surfaces.

11. The contact block of claim 10 wherein said stationary contact module further includes at least one pair of bussing conductors, said bussing conductors being supported by and partially enclosed by said housing, a portion of each said bussing conductor extending outwardly from and generally perpendicularly to said bottom surface to a distal end, said bussing conductors passing through said housing at a point between a longitudinal center line of said stationary contact module and said back surface of said housing.

12. The contact block of claim 11 wherein said distal end of each said bussing member further includes a contact pad on which said stationary contacts are fixedly mounted such that said stationary contacts face said front surface.

13. The contact block of claim 12 wherein said stationary contact module further includes a pair of contact indicators, each extending outwardly from and generally perpendicularly to said top surface at a point between said longitudinal center line of said contact module and said back surface such that the position of said stationary contacts is indicated by said contact indicators.

14. The contact block of claim 13 in which said contact indicators align with one of said NC indicia or said NO indicia depending on which pair of said access apertures said bussing conductors pass through.

15. The contact block of claim 11 wherein said contact module housing defines two passages communicating between said front and back surfaces, each said passage being adjacent one of said bussing conductors such that access is provided to a wire terminal screw associated with said adjacent bussing conductor.

16. The contact block of claim 1 wherein said stationary contact module is attached to said contact block housing by a mounting screw.

17. An electrical control device having a set of auxiliary electrical contacts convertible between a normally open and normally closed state, said control device comprising:

a housing having a generally hollow interior and defining a pair of terminal apertures, a first pair of access apertures and a second pair of access apertures, each of said apertures providing access to said generally hollow interior;

a base enclosed by said housing;

an actuator being supported by said base such that said actuator is slidably movable between a first position and a second position;

means for biasing said actuator to said first position;

at least one pair of contact cavities being defined by said base, each said contact cavity being immediately adjacent said actuator such that said pair of contact cavities is separated by said actuator, said base being positioned within said housing such that said access apertures provide an external access to said contact cavities;

a pair of stationary contacts supported by said base;

a first pair of movable contacts being attached to said actuator such that said first movable contacts are movable between a first position and a second position relative to said pair of stationary contacts;

means for attaching said first pair of movable contacts to said actuator;

two second pairs of movable contacts, said movable contacts being attached to said actuator such that said second movable contacts are movable between a first position and a second position within said contact cavities;

means for attaching said second pairs of movable contacts to said actuator; and a stationary contact module having at least one pair of stationary contacts which can be received through either said first or second pairs of access apertures for being selectively engaged by one of said second pairs of movable contacts in one of said first or second positions.

18. The electrical control device of claim 17 wherein said actuator has a distal end.

19. The electrical control device of claim 18 wherein said actuator is selectively movable from said first position to said second position in response to a force exerted on said distal end.

20. The electrical control device of claim 17 wherein said biasing means is a spring positioned between a portion of said base and said actuator.

21. The electrical control device of claim 17 wherein said actuator is made from an electrically nonconductive material.

22. The electrical control device of claim 21 wherein said means for attaching said first pair of movable contacts to said actuator is a flexible member, said flexible member being generally flat and made from an electrically conductive material.

23. The electrical control device of claim 22 wherein said flexible member is rigidly supported at its approximate midpoint by said actuator such that said flexible member is generally perpendicular to said actuator, said flexible member having two opposing ends extending away from said actuator.

24. The electrical control device of claim 23 wherein one said movable contact is attached to each said opposing end of said flexible member such that said first movable contacts face said stationary contacts.

25. The electrical control device of claim 21 wherein said means for attaching said second pairs of movable contacts to said actuator is a flexible member, said flexible member being generally flat and made from an electrically conductive material.

26. The electrical control device of claim 25 wherein said flexible member is rigidly supported at its approximate midpoint by said actuator such that said flexible member is generally perpendicular to said actuator, said flexible member having two opposing ends extending away from said actuator.

27. The electrical control device of claim 26 wherein one said movable contact is attached to each side of said flexible member at each of said opposing ends.

28. The electrical control device of claim 17 wherein said electrical control device housing further includes an NC indicia adjacent one said pair of access apertures indicating a normally closed function and an NO indicia adjacent the other said pair of access apertures indicating a normally open function.

29. The electrical control device of claim 28 wherein said stationary contact module includes a housing being generally rectangular in shape such that it is defined by a top surface and a bottom surface being generally parallel to and spaced apart from one another, and a front surface and a back surface being generally parallel to and spaced apart from one another, said front and back surfaces being intermediate said top and bottom surfaces.

30. The electrical control device of claim 29 wherein said stationary contact module further includes at least one pair of bussing conductors, said bussing conductors being supported by and partially enclosed by said housing, a portion of each said bussing conductor extending outwardly from and generally perpendicularly to said bottom surface to a distal end, said bussing conductors passing through said housing at a point between a longitudinal center line of said stationary contact module and said back surface of said housing.

31. The electrical control device of claim 30 wherein said distal end of each said bussing conductor further includes a contact pad on which said stationary contacts are fixedly mounted such that said stationary contacts face said front surface of said stationary contact module.

32. The electrical control device of claim 31 wherein said stationary contact module further includes a pair of contact indicators, each extending outwardly from and generally perpendicularly to said top surface at a point between said longitudinal center line of said and said back surface such that the position of said stationary contacts is indicated by said contact indicators.

33. The electrical control device of claim 32 in which said contact indicators of said stationary contact module align with one of said NC indicia or said NO indicia depending on which pair of said access apertures said bussing conductors pass through.

34. The electrical control device of claim 30 wherein said stationary contact module housing defines two passages communicating between said front and back surfaces, each said passage being adjacent one of said bussing conductors such that access is provided to a wire terminal screw associated with said adjacent bussing conductor.

35. The electrical control device of claim 17 wherein said stationary contact module is attached to said electrical control device housing by a mounting screw.

* * * * *